US005251447A

United States Patent [19]

Joshi et al.

[11] Patent Number: 5,251,447

[45] Date of Patent: Oct. 12, 1993

[54] AIR FUEL MIXER FOR GAS TURBINE COMBUSTOR

[75] Inventors: Narendra D. Joshi, Cincinnati; Edward E. Ekstedt, Montgomery; Michael J. Epstein, West Chester; Randall C. Bauer, Hamilton, all of Ohio

[73] Assignee: General Electric Company, Cincinnati, Ohio

[21] Appl. No.: 955,379

[22] Filed: Oct. 1, 1992

[51] Int. Cl.[5] ..... F23R 3/32

[52] U.S. Cl. ..... 60/737; 60/742; 60/748; 431/185; 239/403; 239/424.5

[58] Field of Search ..... 60/737, 738, 739, 742, 60/748; 431/185, 187, 9; 239/403, 416.4, 416.5, 423, 424.5, 425.5

[56] References Cited

U.S. PATENT DOCUMENTS

| | | | |
|---|---|---|---|
| 3,030,773 | 4/1962 | Johnson . | |
| 3,286,997 | 11/1966 | Ledbetter | 239/403 |
| 3,605,405 | 9/1971 | DuBell et al. . | |
| 3,703,259 | 11/1972 | Sturgess et al. | 60/748 |
| 3,713,588 | 1/1973 | Sharpe | 239/400 |
| 3,724,207 | 4/1973 | Johnson . | |
| 3,912,164 | 10/1975 | Lefebvre et al. | 60/748 |
| 3,915,387 | 10/1975 | Caruel et al. | 239/400 |
| 3,917,173 | 11/1975 | Singh | 239/400 |
| 3,927,835 | 12/1975 | Gerrard | 60/748 |

(List continued on next page.)

FOREIGN PATENT DOCUMENTS

| | | | |
|---|---|---|---|
| 0093210 | 4/1990 | Japan | 60/737 |
| 286486 | 10/1952 | Switzerland | 239/403 |
| 0720252 | 3/1980 | U.S.S.R. . | |

OTHER PUBLICATIONS

K. O. Smith, M. H. Samii and H. K. Mak (authors), "Experimental Evaluation of a Low Emissions, Variable Geometry, Small Gas Turbine Combustor", Presented at the Gas Turbine and Aeroengine Congress and Exposition, Jun. 11-14, 1990—Brussels, Belgium.

H. Maghon, P. Berenbrink, H. Termuehlen and G. Gartner (authors), "Progress in NOX and CO Emission Reduction of Gas Turbines", Oct. 21-25, 1990 Pres- (List continued on next page.)

*Primary Examiner*—Richard A. Bertsch
*Assistant Examiner*—Timothy S. Thorpe
*Attorney, Agent, or Firm*—James P. Davidson; Jerome C. Squillaro

[57] ABSTRACT

An air fuel mixer is disclosed having a mixing duct, a shroud surrounding the upstream end of the mixing duct having contained therein a fuel manifold in flow communication with a fuel supply and control means, a set of inner and outer counter-rotating swirlers adjacent the upstream end of the mixing duct, hollow vanes in at least the outer swirler having passages therethrough in fluid communication with the fuel manifold to inject fuel into the mixing duct, and a hub separating the inner and outer swirlers to allow independent rotation thereof, wherein high pressure air from a compressor is injected into the mixing duct through the swirlers to form an intense shear region and fuel is injected into the mixing duct from the swirler vanes so that the high pressure air and the fuel is uniformly mixed therein so as to produce minimal formation of pollutants when the fuel/air mixture is exhausted out the downstream end of the mixing duct into the combustor and ignited. Further, the air fuel mixer of the present invention may include passages in the wall of the mixing duct in fluid communication with the fuel manifold, a centerbody in the mixing duct having a passage therethrough to admit air into the downstream end of the mixing duct, and tubes extending from the passages in the swirler vanes and/or mixing duct wall to inject liquid fuel downstream of the swirlers.

29 Claims, 7 Drawing Sheets

U.S. PATENT DOCUMENTS

| | | | |
|---|---|---|---|
| 3,958,416 | 5/1976 | Hammond et al. | 60/39.65 |
| 3,980,233 | 9/1976 | Simmons et al. | 239/400 |
| 4,023,351 | 5/1977 | Beyler et al. | 60/748 |
| 4,194,358 | 3/1980 | Stenger | 60/748 |
| 4,222,243 | 9/1980 | Mobsby | 60/748 |
| 4,237,694 | 12/1980 | Wood et al. | 60/738 |
| 4,260,367 | 4/1981 | Markowski et al. | 60/742 |
| 4,408,461 | 10/1983 | Bruhwiler et al. . | |
| 4,425,755 | 1/1984 | Hughes | 60/742 |
| 4,598,553 | 7/1986 | Saito et al. | 60/748 |
| 4,653,278 | 6/1987 | Vinson et al. . | |
| 4,701,124 | 10/1987 | Maghon et al. . | |
| 4,835,959 | 6/1989 | Coffinberry . | |
| 4,930,430 | 6/1990 | Allen et al,. | 431/185 |
| 4,932,861 | 6/1990 | Keller et al. . | |
| 5,009,589 | 4/1991 | Sherelton et al. . | |
| 5,020,329 | 6/1991 | Ekstedt et al. | 60/737 |
| 5,062,792 | 11/1991 | Maghon . | |
| 5,066,221 | 11/1991 | Becker . | |
| 5,165,241 | 11/1992 | Joshi et al. | 60/737 |

OTHER PUBLICATIONS ented at the Joint ASME/IEEE Power Generation Conference, Boston, Mass.

A. Sviridenkov and V. Tret'yakov (authors), "Distribution of Velocity Pulsations in a Channel with Mixing of Oppositely Swirled Streams", pp. 47–53, Jul. 1984 (translated from Inzhenerno–Fizicheskii Zhurnal, vol. 47, No. 1) Original article submitted Apr. 8, 1983.

A. Sviridenkov, V. Tret'yakov and V. Yagodkin (authors), "Effectiveness of Mixing Coaxial Flows Swirled in Opposite Directions", pp. 407–413, Sep., 1981; translated from Inzhenerno–Fizicheskii Zhurnal, vol. 41, No. 3. Original article submitted Jun. 23, 1980.

W. Cheng (author), "Reactive Mixing in Swirling Flows", Presented Jul. 14–16, 1980, AIAA 13th Fluid & Plasma Dynamics Conference, Snowmass, Colo.

A. Goyal, E. Ekstedt and A. Szaniszlo (authors), "NASA Advanced Low Emissions Combustor Program".

AIR FUEL MIXER FOR GAS TURBINE COMBUSTOR

BACKGROUND OF THE INVENTION

1. Field of the Invention

The present invention relates to an air fuel mixer for the combustor of a gas turbine engine, and, more particularly, to an air fuel mixer for the combustor of a gas turbine engine which uniformly mixes fuel and air so as to reduce NOx formed by the ignition of the fuel/air mixture.

2. Description of Related Art

Air pollution concerns worldwide have led to stricter emissions standards requiring significant reductions in gas turbine pollutant emissions, especially for industrial and power generation applications. Nitrous Oxide (NOx), which is a precursor to atmospheric pollution, is generally formed in the high temperature regions of the gas turbine combustor by direct oxidation of atmospheric nitrogen with oxygen. Reductions in gas turbine emissions of NOx have been obtained by the reduction of flame temperatures in the combustor, such as through the injection of high purity water or steam in the combustor. Additionally, exhaust gas emissions have been reduced through measures such as selective catalytic reduction. While both the wet techniques (water/steam injection) and selective catalytic reduction have proven themselves in the field, both of these techniques require extensive use of ancillary equipment. Obviously, this drives the cost of energy production higher. Other techniques for the reduction of gas turbine emissions include "rich burn, quick quench, lean burn" and "lean premix" combustion, where the fuel is burned at a lower temperature.

In a typical aero-derivative industrial gas turbine engine, fuel is burned in an annular combustor. The fuel is metered and injected into the combustor by means of multiple nozzles into a venturi along with combustion air having a designated amount of swirl. No particular care has been exercised in the prior art, however, in the design of the nozzle, the venturi or the dome end of the combustor to mix the fuel and air uniformly to reduce the flame temperatures. Accordingly, non-uniformity of the air/fuel mixture causes the flame to be locally hotter, leading to significantly enhanced production of NOx.

In the typical aircraft gas turbine engine, flame stability and variable cycle operation of the engine dominate combustor design requirements. This has in general resulted in combustor designs with the combustion at the dome end of the combustor proceeding at the highest possible temperatures at stoichiometeric conditions. This, in turn, leads to large quantities of NOx being formed in such gas turbine combustors since it has been of secondary importance.

While premixing ducts in the prior art have been utilized in lean burning designs, they have been found to be unsatisfactory due to flashback and auto-ignition considerations for modern gas turbine applications. Flashback involves the flame of the combustor being drawn back into the mixing section, which is most often caused by a backflow from the combustor due to compressor instability and transient flows. Auto-ignition of the fuel/air mixture can occur within the premixing duct if the velocity of the air flow is not fast enough, i.e., where there is a local region of high residence time. Flashback and auto-ignition have become serious considerations in the design of mixers for aero-derivative engines due to increased pressure ratios and operating temperatures. Since one desired application of the present invention is for the LM6000 gas turbine engine, which is the aero-derivative of General Electric's CF6-80C2 engine, these considerations are of primary significance.

An air fuel mixer for gas turbine combustors to provide uniform mixing, previously filed by the assignee of the current invention, now U.S. Pat. No. 5,165,241 includes a mixing duct, a set of inner and outer annular counter-rotating swirlers at the upstream end of the mixing duct and a fuel nozzle located axially along and forming a centerbody of the mixing duct, wherein high pressure air from a compressor is injected into the mixing duct through the swirlers to form an intense shear region and fuel is injected into the mixing duct through the centerbody. However, this design is useful only for the introduction of gaseous fuel to the combustor. Further, while mixing is improved over the designs of the prior art, even more uniform mixing is still desirable.

Accordingly, a primary objective of the present invention is to provide an air fuel mixer for an aero-derivative gas turbine engine which avoids the problems of auto-ignition and flashback.

Another objective of the present invention is to provide an air fuel mixer which includes means for providing an intense shear region therein which causes uniform mixing of fuel and high pressure air to minimize the formation of pollutants when the fuel/air mixture is exhausted out the downstream end of the mixer into the combustor and ignited.

Yet another objective of the present invention is to provide an air fuel mixer which more uniformly mixes fuel and air without incurring backflow from the combustor.

Another objective of the present invention is to provide an air fuel mixer which supplies a significant swirl to the fuel/air mixture so as to result in an adverse pressure gradient in the primary combustion region of the combustor and a consequent hot recirculation zone therein.

A further objective of the present invention is to provide an air fuel mixer which has the ability to uniformly mix liquid fuel.

Still another objective of the present invention is to inject fuel into an air fuel mixer in such a manner as to maximize mixing therein.

Another objective of the present invention is to provide an air fuel mixer which provides the maximum amount of mixing between fuel and air supplied thereto in the limited amount of space available in an aero. derivative engine.

These objectives and other features of the present invention will become more readily apparent upon reference to the following description when taken in conjunction with the following drawing.

SUMMARY OF THE INVENTION

In accordance with one aspect of the present invention, an air fuel mixer is disclosed having a mixing duct, a shroud surrounding the upstream end of the mixing duct having contained therein a fuel manifold in flow communication with a fuel supply and control means, a set of inner and outer counter-rotating swirlers adjacent the upstream end of the mixing duct, hollow vanes in at least the outer swirler having passages therethrough in fluid communication with the fuel manifold to inject fuel into the mixing duct, and a hub separating the inner and outer swirlers to allow independent rotation thereof, wherein high pressure air from a compressor is injected into the mixing duct through the swirlers to form an intense shear region and fuel is injected into the mixing duct from the swirler vanes so that the high pressure air and the fuel is uniformly mixed therein so as to produce minimal formation of pollutants when the fuel/air mixture is exhausted out the downstream end of the mixing duct into the combustor and ignited. Further, the air fuel mixer of the present invention may include passages in the wall of the mixing duct in fluid communication with the fuel manifold, a centerbody in the mixing duct having a passage therethrough to admit air into the downstream end of the mixing duct, and tubes extending from the passages in the swirler vanes and/or mixing duct wall to inject liquid fuel downstream of the swirlers.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
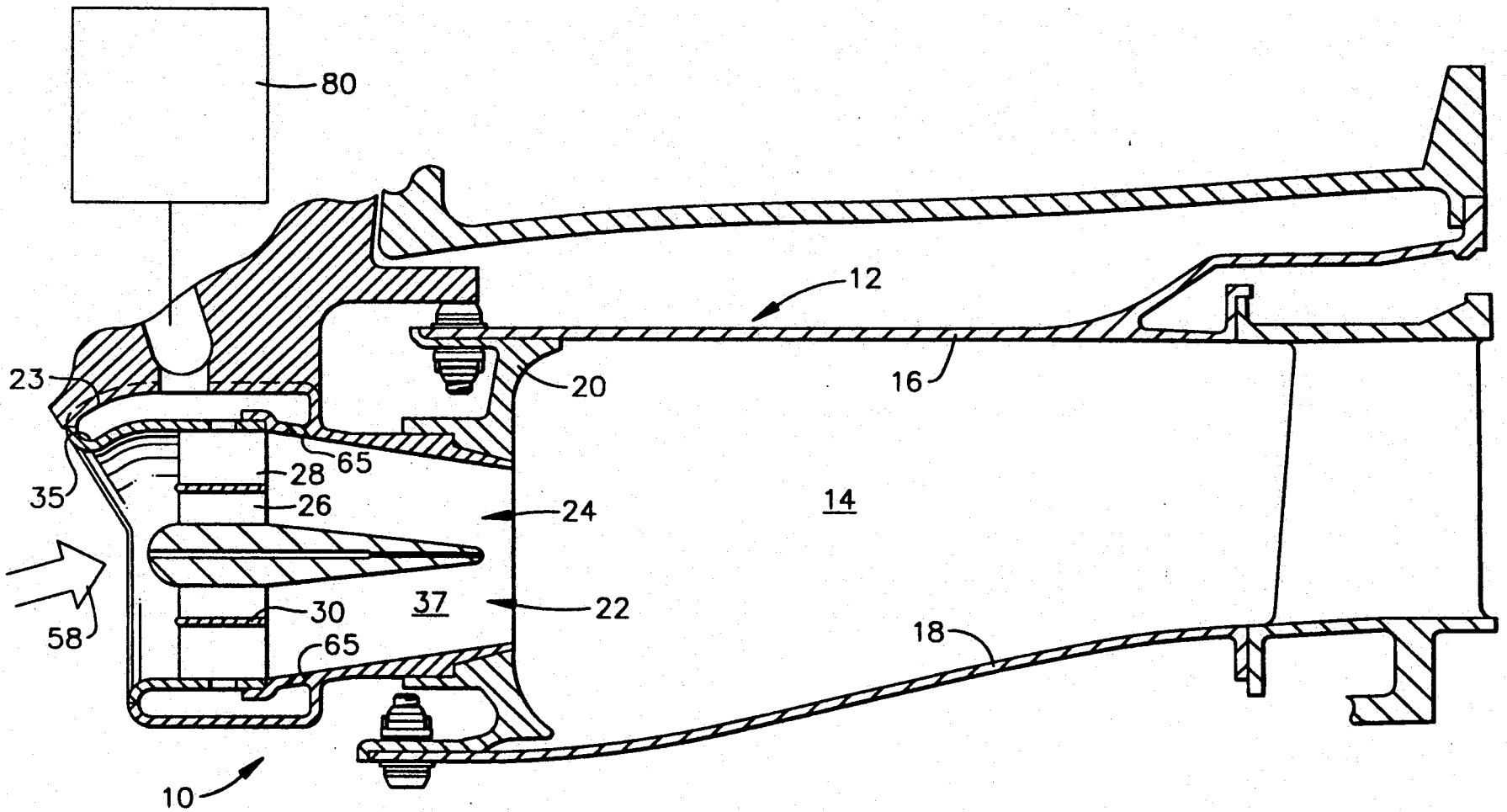
FIG. 1 is a cross-sectional view through a single annular combustor structure including the air fuel mixer of the present invention.

Referring now to the drawings in detail, wherein identical numerals indicate the same elements throughout the figures, FIG. 1 depicts a continuous-burning combustion apparatus 10 of the type suitable for use in a gas turbine engine and comprising a hollow body 12 defining a combustion chamber 14 therein. Hollow body 12 is generally annular in form and is comprised of an outer liner 16, an inner liner 18, and a domed end or dome 20. It should be understood, however, that this invention is not limited to such an annular configuration and may well be employed with equal effectiveness in combustion apparatus of the well-known cylindrical can or cannular type, as well as combustors having a plurality of annuli. In the present annular configuration, the domed end 20 of hollow body 12 includes a swirl cup 22, having disposed therein a mixer 24 of the present invention to allow the uniform mixing of fuel and air therein and the subsequent introduction of the fuel/air mixture into combustion chamber 14 with the minimal formation of pollutants caused by the ignition thereof. Swirl cup 22, which is shown generally in FIG. 1, is made up of mixer 24 and the swirling means described below.

Figure 2:
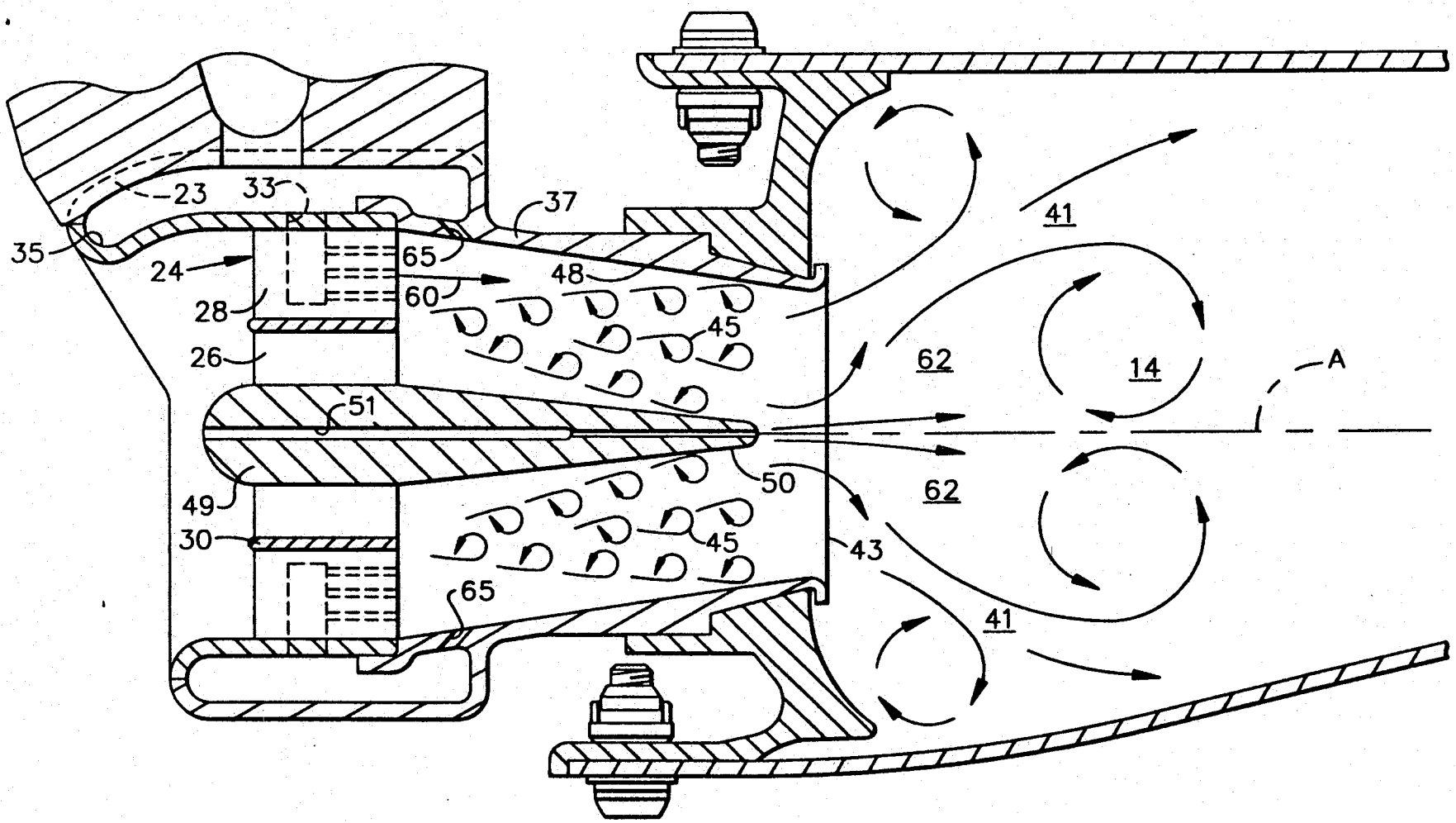
FIG. 2 is an enlarged cross-sectional view of the air fuel mixer of the present invention and combustor dome portion of FIG. 1 which depicts the air flow therein.
Figure 3:
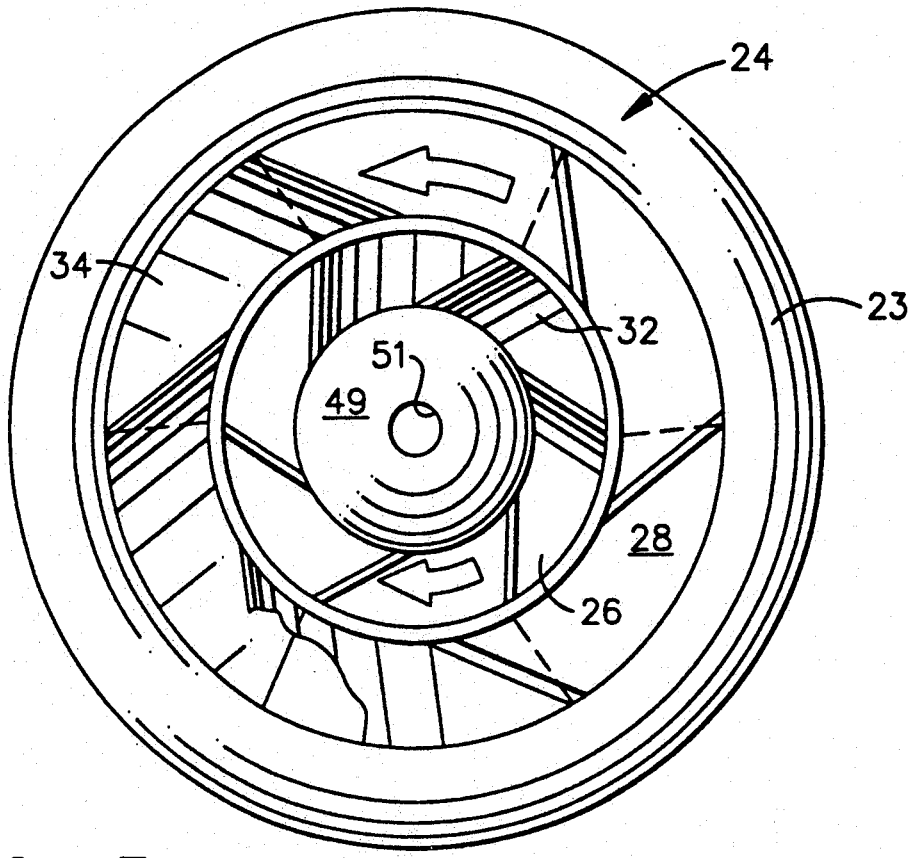
FIG. 3 is a front view of the air fuel mixer depicted in FIG. 2 of the present invention.
Figure 6:
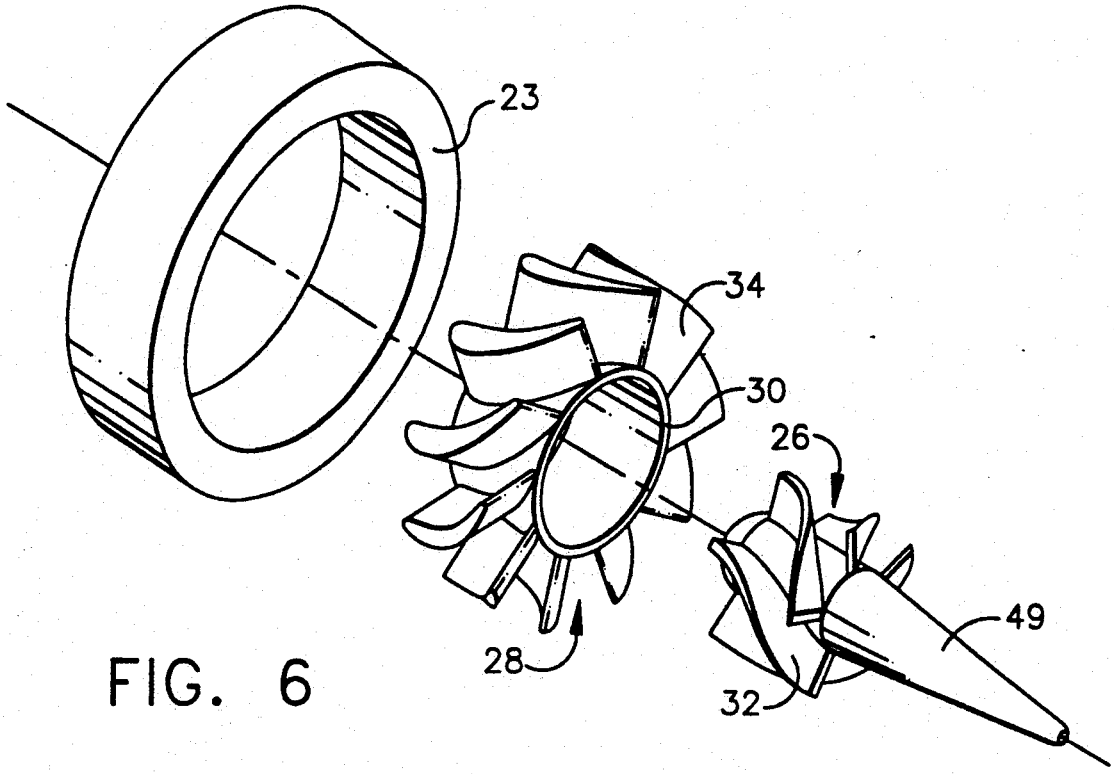
FIG. 6 is an exploded perspective view of the air fuel mixer depicted in FIG. 2.
Figure 7:
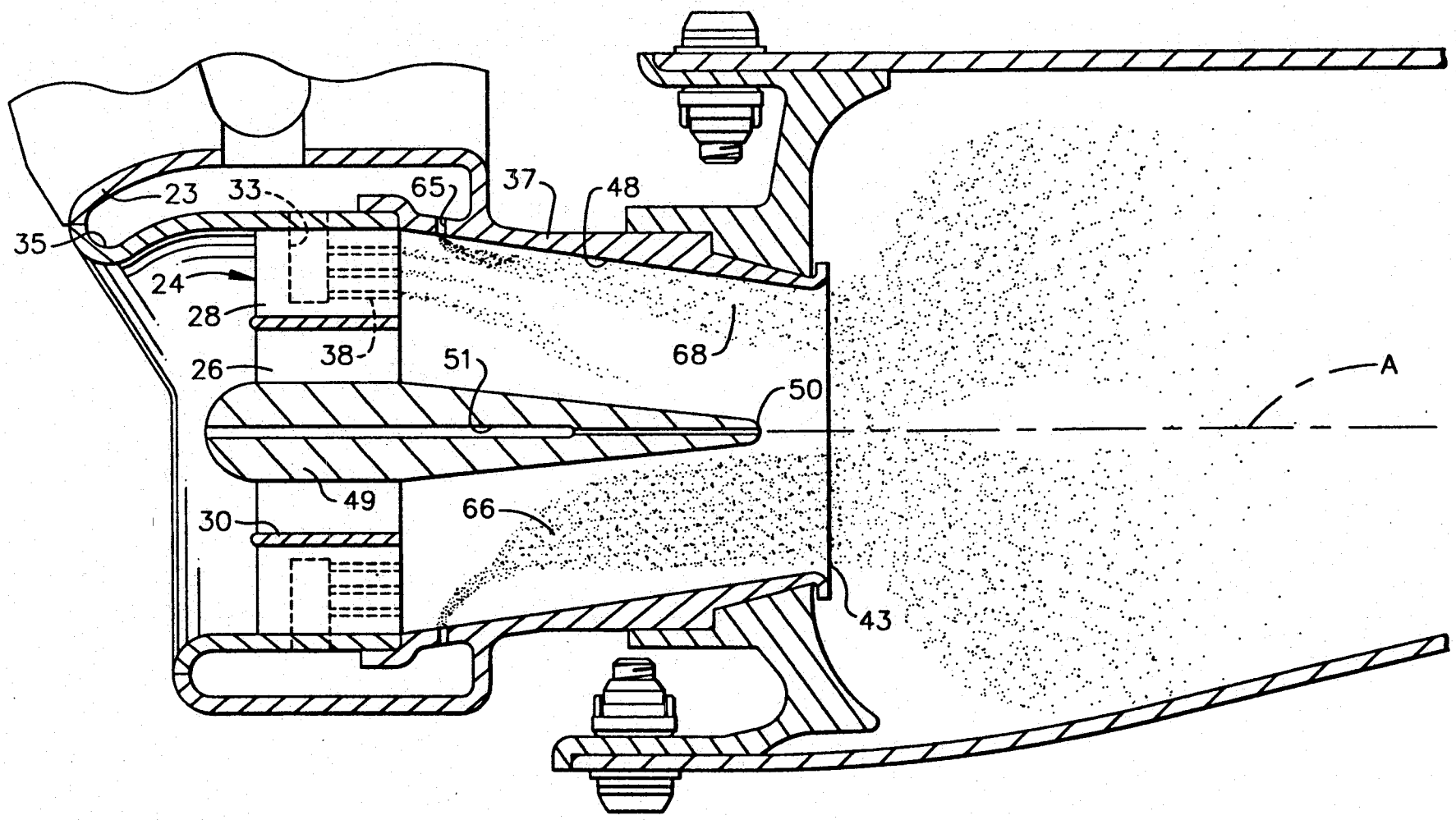
FIG. 7 is an enlarged cross-sectional view of the air fuel mixer of the present invention and combustor dome portion of FIG. 1 which depicts the fuel flow through the mixing duct wall passages.

As best seen in FIGS. 2, 6 and 7, mixer 24 includes inner swirler 26 and outer swirler 28 which are brazed or otherwise set in swirl cup 22, where inner and outer swirlers 26 and 28 preferably are counter-rotating (see FIG. 3). It is of no significance which direction inner swirler 26 and outer swirler 28 rotate so long as they do so in opposite directions. Inner and outer swirlers 26 and 28 are separated by a hub 30, which allows them to be co-annular and separately rotatable. As depicted in FIGS. 2 and 7, inner and outer swirlers 26 and 28 are preferably axial, but they may be radial or some combination of axial and radial. It will be noted that swirlers 26 and 28 have vanes 32 and 34 (see FIG. 3) at an angle in the 40°-60° range with an axis A running through the center of mixer 24. Also, the air mass ratio between inner swirler 26 and outer swirler 28 is preferably approximately $\frac{1}{3}$.

As best seen in FIGS. 2 and 7, a shroud 23 is provided which surrounds mixer 24 at the upstream end thereof with a fuel manifold 35 contained therein. Downstream of inner and outer swirlers 26 and 28 is an annular mixing duct 37. Fuel manifold 35 is in flow communication with vanes 34 of outer swirler 28 and is metered by an appropriate fuel supply and control mechanism 80. Although not depicted in the figures, fuel manifold 35 could be altered so as to be in flow communication with vanes 32 of inner swirler 26.

Figure 4A:
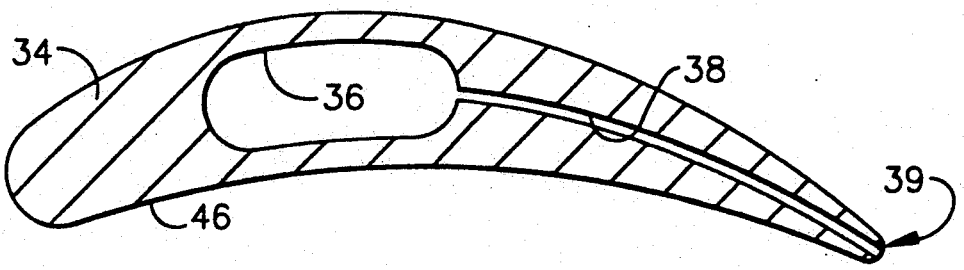
FIG. 4A is a cross-sectional view of a vane in the outer swirler of FIGS. 2 and 3 depicting a passage from the internal cavity to the trailing edge.
Figure 4B:
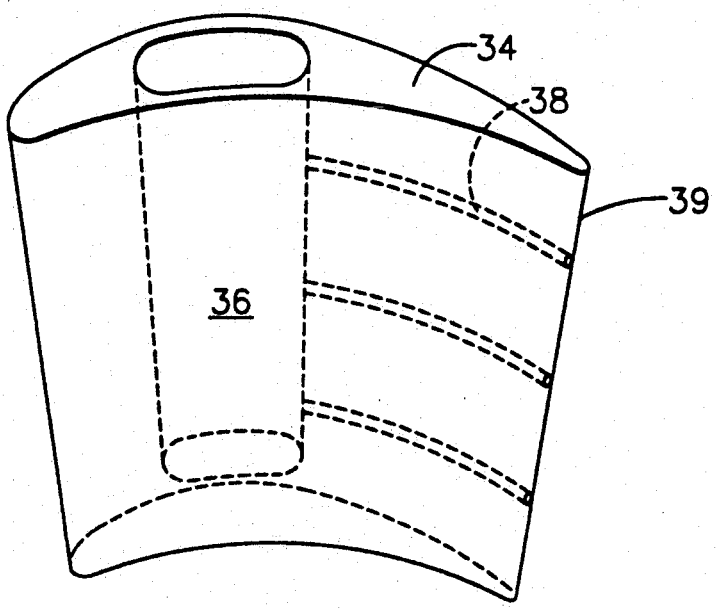
FIG. 4B is a perspective view of the vane in FIG. 4A.

More particularly, vanes 34 are of a hollow design as shown in FIGS. 4*a* and 4*b*. As depicted therein, vanes 34 have an internal cavity 36 therethrough located adjacent the larger leading edge portion 46 which is in flow communication with fuel manifold 35 by means of passage 33. Preferably, each of vanes 34 has a plurality of passages 38 from internal cavity 36 to trailing edge 39 of such vane. Passages 38 may be drilled by lasers or other known methods, and are utilized to inject gaseous fuel into the air stream at trailing edge 39 so as to improve macromixing of the fuel with the air. Passages 38, which have a diameter of approximately 0.6 millimeter (24 mils), are sized in order to minimize plugging therein while maximizing air/fuel mixing. The number and size of passages 38 in vanes 34 is dependent on the amount of fuel flowing through fuel manifold 35, the pressure of the fuel, and the number and particular design of the vanes of swirlers 26 and 28; however, it has been found that three passages work adequately.

Figure 5A:
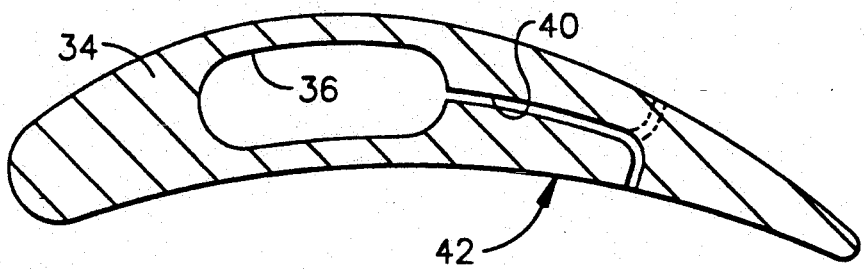
FIG. 5A is a cross-sectional view of an alternate embodiment for the vane in the outer swirler of FIGS. 2 and 3 depicting a passage from the internal cavity to the pressure surface (solid lines) or suction surface (dashed lines)
Figure 5B:
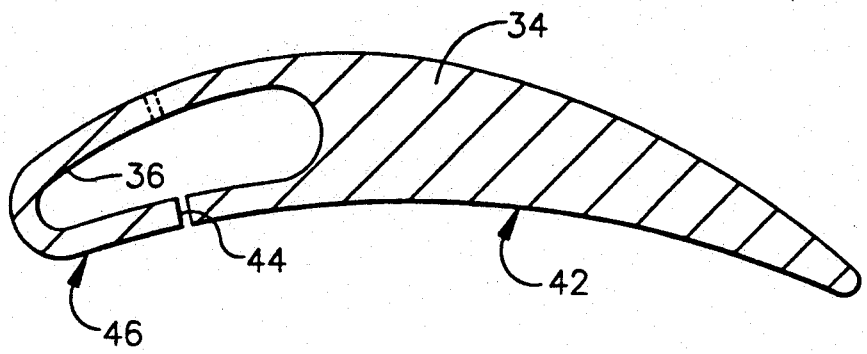
FIG. 5B is a cross-sectional view of another alternate embodiment for the vane in the outer swirler of FIGS. 2 and 3 depicting a passage from the internal cavity to the pressure surface (solid lines) or suction surface (dashed lines) adjacent the leading edge portion.

In the alternate embodiments depicted in FIGS. 5*a* and 5*b*, respectively, passages 40 and 44 extend from vane internal cavity 36 either a distance downstream or merely through leading edge portion 46 to terminate substantially perpendicular to a pressure surface 42 (solid lines) or a suction surface (dashed lines) of vane 34. These alternate embodiments have the advantage of allowing the energy of the air stream contribute to mixing so long as the passages terminate substantially perpendicular to air stream 60.

A centerbody 49 is provided in mixer 24 which may be a straight cylindrical section or preferably one which converges substantially uniformly from its upstream end to its downstream end. Centerbody 49 is preferably cast within mixer 24 and is sized so as to terminate immediately prior to the downstream end of mixing duct 37 in order to address a distress problem at centerbody tip 50, which occurs at high pressures due to flame stabilization at this location. Centerbody 49 preferably includes a passage 51 therethrough in order to admit air of a relatively high axial velocity into combustion chamber 14 adjacent centerbody tip 50. In order to assist in forming passage 51, it may not have a uniform diameter throughout. This design then decreases the local fuel/air ratio to help push the flame downstream of centerbody tip 50.

Inner and outer swirlers 26 and 28 are designed to pass a specified amount of air flow and fuel manifold 35 is sized to permit a specified amount of fuel flow so as to result in a lean premixture at exit plane 43 of mixer 24. By "lean" it is meant that the fuel/air mixture contains more air than is required to fully combust the fuel, or an equivalence ratio of less than one. It has been found that an equivalence ratio in the range of 0.4 to 0.7 is preferred.

As seen in FIG. 2, the air flow 60 exiting inner swirler 26 and outer swirler 28 sets up an intense shear layer 45 in mixing duct 37. The shear layer 45 is tailored to enhance the mixing process, whereby fuel flowing through vanes 34 are uniformly mixed with intense shear layer 45 from swirlers 26 and 28, as well as prevent backflow along the outer wall 48 of mixing duct 37. Mixing duct 37 may be a straight cylindrical section, but preferably should be uniformly converging from its upstream end to its downstream end so as to increase fuel velocities and prevent backflow from primary combustion region 62. Additionally, the converging design of mixing duct 37 acts to accelerate the fuel/air mixture flow uniformly, which prevents boundary layers from accumulating along the sides thereof and flashback stemming therefrom. (Inner and outer swirlers 26 and 28 may also be of a like converging design).

An additional means for introducing fuel into mixing duct 37 is a plurality of passages 65 through wall 48 of mixing duct 37 which are in flow communication with fuel manifold 35. As seen in FIG. 7, passages 65 may be in line with the wakes of outer swirler vanes 34 (as shown in the inner radial portion of mixing duct 37 in FIG. 7) in order to be sheltered from the high velocity air flow caused by vanes 34, which allows fuel flow 66 to penetrate further into the air flow field and thus approximately to centerbody 49 within mixing duct 37. Alternatively, passages 65 may be located between wakes of outer swirler vanes 34 (as shown in the outer radial portion of mixing duct 37 in FIG. 7.) in order to turn the flow of fuel 68 rapidly along the interior surface of wall 48 of mixing duct 37 to feed fuel to the outer regions of mixing duct 37. In order to prevent boundary layers from building up on passage walls, the cross-sectional area of conical mixing duct 37 preferably decreases from the upstream end to the downstream end by approximately a factor of two.

Figure 9:
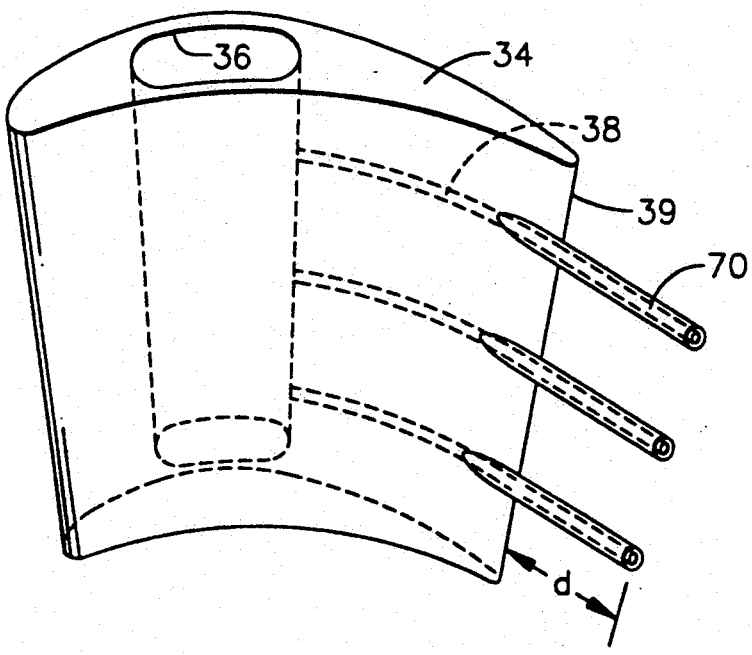
FIG. 9 is a perspective view of the outer swirler vane in FIG. 8.
Figure 10:
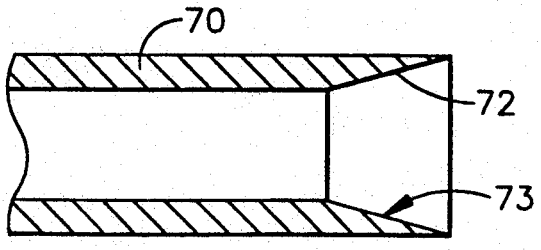
FIG. 10 is a partial cross-sectional view of the tubes depicted in FIGS. 8 and 9 showing a chamfer at its end.
Figure 8:
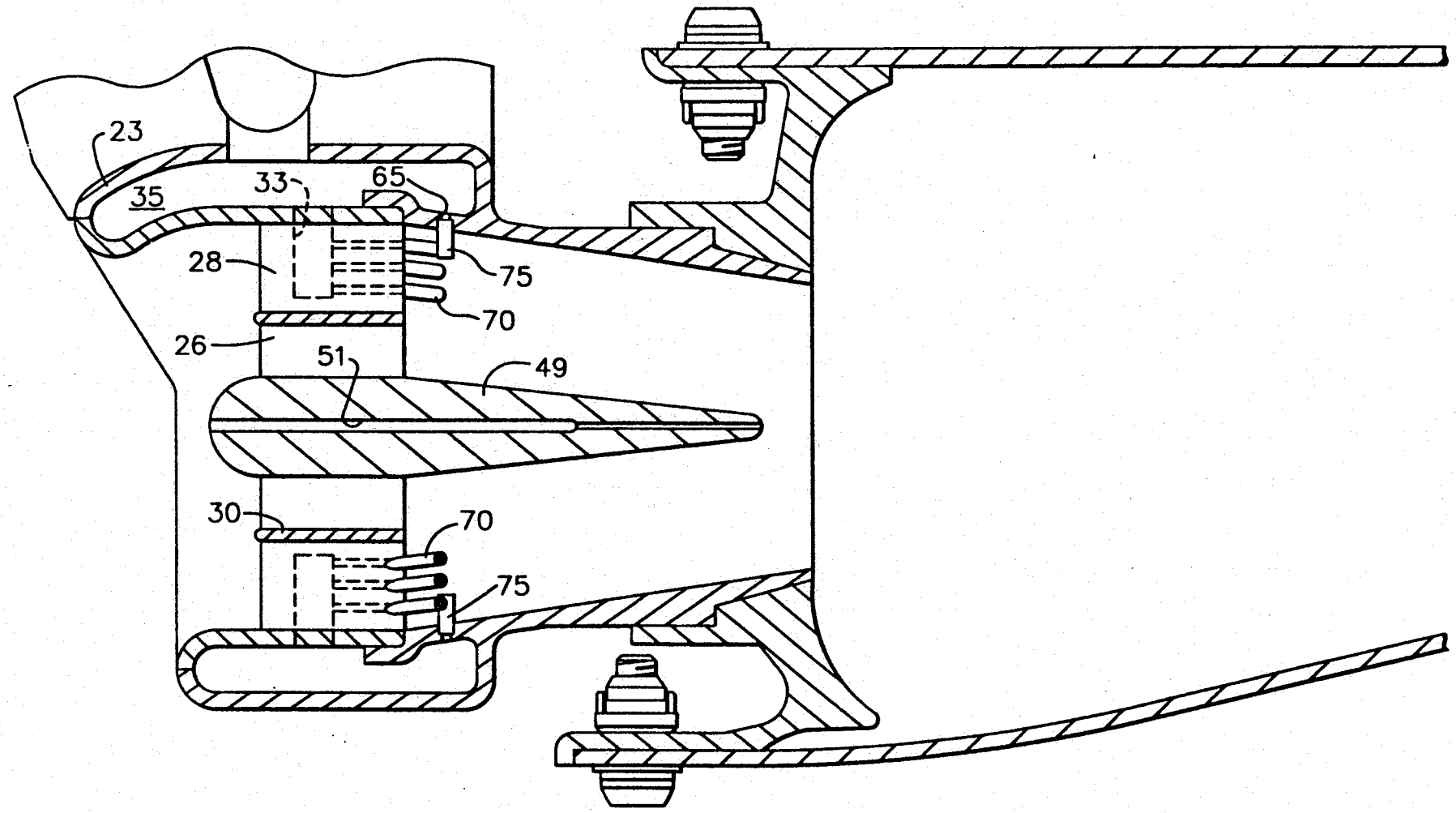
FIG. 8 is an enlarged cross-sectional view of an alternate embodiment of the air fuel mixer of the present invention which includes tubes at the end of the fuel passages in the outer swirler vanes and the outer mixing duct wall for use with liquid fuel.

A further modification to the preferred embodiment described hereinabove is the addition of tubes 70 (shown in FIGS. 8–10) which extend aft of vane trailing edge 39 a distance d. Tubes 70 are utilized to inject liquid fuel supplied by fuel manifold 35 into the air stream 60 at the upstream end of mixing duct 37. In this manner, the fuel and air is mixed and evaporated by the intense shear between the inner and outer swirled flow while preventing the liquid fuel from being entrained in the wakes of vanes 34 where it could auto-ignite. As shown in FIG. 10, tubes 70 also preferably have a sharp chamfered edge 72 at their exit ends in order to minimize the potential for liquid fuel to be entrained by a recirculation zone on tube trailing edge 73 which could cause auto-ignition. Likewise, tubes 75 of similar construction may be utilized in conjunction with passages 65 in mixing duct wall 48 when liquid fuel is injected therethrough.

In operation, compressed air 58 from a compressor (not shown) is injected into the upstream end of mixer 24 where it passes through inner and outer swirlers 26 and 28 and enters mixing duct 37. Fuel is injected into air flow stream 60 (which includes intense shear layers 45) from passages 38 in vanes 34 and/or passages 65 in flow communication with fuel manifold 35. At the downstream end of mixing duct 37, the fuel/air mixture is exhausted into a primary combustion region 62 of combustion chamber 14 which is bounded by inner and outer liners 18 and 16. The fuel/air mixture then burns in combustion chamber 14, where a flame recirculation zone 41 is set up with help from the swirling flow exiting mixing duct 37. In particular, it should be emphasized that the two counter-rotating air streams emanating from swirlers 26 and 28 form very energetic shear layers 45 where intense mixing of fuel and air is achieved by intense dissipation of turbulent energy of the two co-flowing air streams. The fuel is injected into these energetic shear layers 45 so that macro (approximately 1 inch) and micro (approximately one thousandth of an inch or smaller) mixing takes place in a very short region or distance. In this way, the maximum amount of mixing between the fuel and air supplied to mixing duct 37 takes place in the limited amount of space available in an aero-derivative engine (approximately 2–4 inches).

Testing of the invention disclosed herein reveals that NOx levels of as low as one part per million have been achieved. Naturally, such NOx levels in a "dry" environment (one without water or steam injection) are clearly superior to levels attained by other engines in the art.

It is important to note that mixing duct 37 is sized to be just long enough for mixing of the fuel and air to be completed in mixing duct 37 without the swirl provided by inner and outer swirlers 26 and 28 having dissipated to a degree where the swirl does not support flame recirculation zone 41 in primary combustion region 62. In order to enhance the swirled fuel/air mixture to turn radially out and establish the adverse pressure gradient in primary combustion region 62 to establish and enhance flame recirculation zone 41, the downstream end of mixing duct 37 may be flared outward as shown in FIGS. 2 and 7. Flame recirculation zone 41 then acts to promote ignition of the new "cold" fuel/air mixture entering primary combustion region 62.

Alternatively, mixing duct 37 and swirlers 26 and 28 may be sized such that there is little swirl at the downstream end of mixing duct 37. Consequently, the flame downstream becomes stabilized by conventional jet flame stabilization behind a bluff body (e.g., a perforated plate).

Having shown and described the preferred embodiment of the present invention, further adaptations of the mixer for providing uniform mixing of fuel and air can be accomplished by appropriate modifications by one of ordinary skilled in the art without departing from the scope of the invention.

We claim:

1. An apparatus for premixing fuel and air prior to combustion in a gas turbine engine, comprising:

(a) a linear mixing duct having a circular cross-section defined by a wall;

(b) a shroud surrounding the upstream end of said mixing duct, said shroud having contained therein a fuel mainfold in flow communication with a fuel supply and control means;

(c) a set of inner and outer annular counter-rotating swirlers adjacent the upstream end of said mixing duct for imparting swirl to an air stream, said inner and outer annular swirlers including hollow vanes with internal cavities, wherein the internal cavities of at least said outer swirler vanes are in fluid communication with said fuel manifold, and said outer swirler vanes have a plurality of passages therethrough in flow communication with said internal cavities to inject fuel into said air stream; and (d) a hub separating said inner and outer annular swirlers to allow independent rotation thereof, said hub extending only the length of said swirlers;

wherein high pressure air from a compressor is injected into said mixing duct through said swirlers to form an intense shear region and fuel is injected into said mixing duct from said swirler vane passages so that the high pressure air and the fuel is uniformly mixed therein so as to produce minimal formation of pollutants when the fuel/air mixture is exhausted out the downstream end of said mixing duct into the combustor and ignited.

2. The apparatus of claim 1, further comprising a centerbody located axially along said mixing duct and radially inward of said inner annular swirler.

3. The apparatus of claim 1, wherein said outer swirler vane passages terminate adjacent a trailing edge of said vanes.

4. The apparatus of claim 1, wherein said outer swirler vane passages terminate substantially perpendicular to said air flow.

5. The apparatus of claim 4 wherein said outer swirler vane passages terminate adjacent a leading edge portion of said vanes.

6. The apparatus of claim 2, wherein said centerbody includes a passage therethrough to admit air downstream of said mixing duct.

7. The apparatus of claim 6, wherein said centerbody terminates immediately prior to the downstream end of said mixing duct.

8. The apparatus of claim 1, wherein a lean premixture of air and fuel is provided at an exit plane of said mixing duct.

9. The apparatus of claim 1, wherein said swirlers are axial.

10. The apparatus of claim 1, wherein at least one of said swirlers is radial.

11. The apparatus of claim 1, wherein significant swirl is imparted to the fuel/air mixture so as to result in an adverse pressure gradient in a primary combustion region of the combustor, whereby a hot recirculation zone is established and enhanced in said primary combustion region.

12. The apparatus of claim 1, wherein said mixing duct converges substantially uniformly as it extends from its upstream end to its downstream end.

13. The apparatus of claim 11, wherein said mixing duct is sized to be just long enough for mixing to be completed in said duct without the swirl provided by said swirlers having dissipated to a degree where the swirl does not support a recirculation zone in the primary combustion region.

14. The apparatus of claim 1 further including a plurality of passages through said mixing duct wall terminating downstream of said swirlers, said mixing duct wall passages being in fluid communication with said fuel mainfold.

15. The apparatus of claim 14, wherein said mixing duct wall passages are located in line with wakes caused by said outer swirler vanes, whereby fuel flow therethrough is able to penetrate air flow in said mixing duct adjacent to said centerbody therein.

16. The apparatus of claim 14, wherein said mixing duct wall passages are located between wakes caused by said outer swirler vanes, whereby fuel flow therethrough is turned along an inside surface of said mixing duct wall by air flow in said mixing duct.

17. The apparatus of claim 14, wherein said mixing duct wall passages inject fuel substantially perpendicular to air flow in said mixing duct.

18. The apparatus of claim 14, wherein said mixing duct wall passages inject fuel at an angle to air flow in said mixing duct in the range of 20 to 60 degrees.

19. The apparatus of claim 1, wherein the downstream end of said mixing duct is flared outwards to enable the swirled fuel/air mixture to turn radially out and establish the adverse pressure gradient in the primary combustion region to establish and enhance said recirculation zone.

20. The apparatus of claim 3, further including tubes extending aft of said vane trailing edge for injecting liquid fuel into said mixing duct downstream of said vanes.

21. The apparatus of claim 14, further including tubes extending from said mixing duct wall passages for injecting liquid fuel into said mixing duct downstream of said swirlers.

22. The apparatus of claim 20, wherein said tubes have a chamfer at the downstream end thereof.

23. An apparatus for premixing fuel and air prior to combustion in a gas turbine engine, comprising;

(a) a linear mixing duct having a circular cross-section defined by a wall, said wall having a plurality of passages formed therethrough;

(b) a shroud surrounding the upstream end of said mixing duct, said shroud having contained therein a fuel manifold in fluid communication with a fuel supply and control means and in fluid communication with said mixing duct wall passages;

(c) a set of inner and outer annular counter-rotating swirlers adjacent the upstream end of said mixing duct; and (d) a hub separating said inner and outer annular swirlers to allow independent rotation thereof, said hub extending only the length of said swirlers;

wherein high pressure air from a compressor is injected into said mixing duct through said swirlers to form an intense shear region and fuel is injected into said mixing duct from said passages in said mixing duct wall so that the high pressure air and the fuel is uniformly mixed therein so as to produce minimal formation of pollutants when the fuel/air mixture is exhausted out the downstream end of said mixing duct into the combustor and ignited.

24. The apparatus of claim 23, further comprising a centerbody located axially along said mixing duct and radially inward of said inner annular swirler.

25. The apparatus of claim 23, wherein said mixing duct wall passages are located in line with wakes caused by said outer swirler vanes, whereby fuel flow therethrough is able to penetrate air flow in said mixing duct adjacent to said centerbody therein.

26. The apparatus of claim 23 wherein said mixing duct wall passages are located between wakes caused by said outer swirler vanes, whereby fuel flow therethrough is turned along an inside surface of said mixing duct wall by air flow in said mixing duct.

27. The apparatus of claim 23 wherein said mixing duct wall passages inject fuel substantially perpendicular to air flow in said mixing duct.

28. The apparatus of claim 23 wherein said mixing duct wall passages inject fuel at an angle to air flow in said mixing duct in the range of 20 to 60 degrees.

29. The apparatus of claim 23 further including tubes extending from said mixing duct outer wall passages for injecting liquid fuel into said mixing duct downstream of said swirlers.

* * * * *